United States Patent [19]

Botsch et al.

[11] 4,163,636

[45] Aug. 7, 1979

[54] LIFTING DEVICE FOR WATER, WASTE WATER, SLUDGE AND THE LIKE

[75] Inventors: Bertram Botsch, Karlsruhe; Werner Marzluf, Moersch, both of Fed. Rep. of Germany

[73] Assignee: Maschinenfabrik Hellmut Geiger, Postfach, Fed. Rep. of Germany

[21] Appl. No.: 707,776

[22] Filed: Jul. 22, 1976

Related U.S. Application Data

[62] Division of Ser. No. 493,778, Aug. 1, 1974, Pat. No. 3,994,616.

[30] Foreign Application Priority Data

Aug. 2, 1973 [DE] Fed. Rep. of Germany ..... 2339187
Jul. 15, 1974 [DE] Fed. Rep. of Germany ..... 2433917

[51] Int. Cl.[2] ..... F04D 23/00

[52] U.S. Cl. ..... 415/6; 198/723; 198/716

[58] Field of Search ..... 415/6; 198/702, 723, 198/716; 417/329

[56] References Cited

U.S. PATENT DOCUMENTS

| | | | |
|---|---|---|---|
| 1,930 | 1/1844 | Henry | 415/6 |
| 810,066 | 1/1906 | Maguin | 415/6 X |
| 1,021,895 | 4/1912 | Schichtl | 415/6 |
| 1,085,127 | 1/1914 | Howell | 415/6 |
| 1,190,721 | 7/1916 | Campbell | 198/702 X |
| 2,877,051 | 3/1959 | Cushman et al. | 415/6 X |

FOREIGN PATENT DOCUMENTS

| | | | |
|---|---|---|---|
| 1528932 | 3/1972 | Fed. Rep. of Germany | 415/6 |
| 908728 | 10/1945 | France | 415/6 |
| 51668 | 6/1920 | Sweden | 415/6 |
| 56421 | 7/1911 | Switzerland | 415/6 |

*Primary Examiner*—Carlton R. Croyle
*Assistant Examiner*—R. E. Gluck
*Attorney, Agent, or Firm*—Ernest F. Marmorek

[57] ABSTRACT

A conveying device for conveying liquid from a supply well features an upright wall having one major surface and extending into the well, conveying means comprising a disk rotatably mounted about a substantially horizontal axis and a plurality of separations connected to the disk about the axis, the wall abutting the separations, a portion of the surface of the wall, the separations and the disk defining cells for conveying the liquid along at least part of the wall surface, and an output channel defined in the wall and intercommunicating with at least one of the cells when in a position near the top of the disk for emptying liquid from the cells as they reach the position;

whereby, when the disk is rotated, it will move the separations into the liquid and the cells will substantially retain their liquid contents until they reach the position.

4 Claims, 8 Drawing Figures

Figure 1:
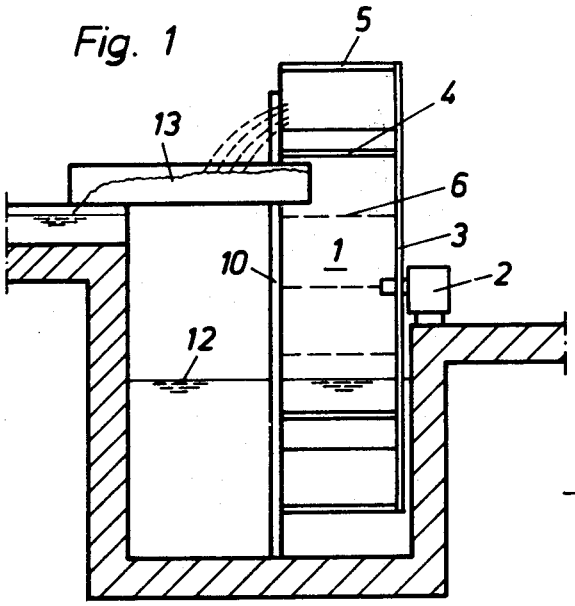

Fig. 6
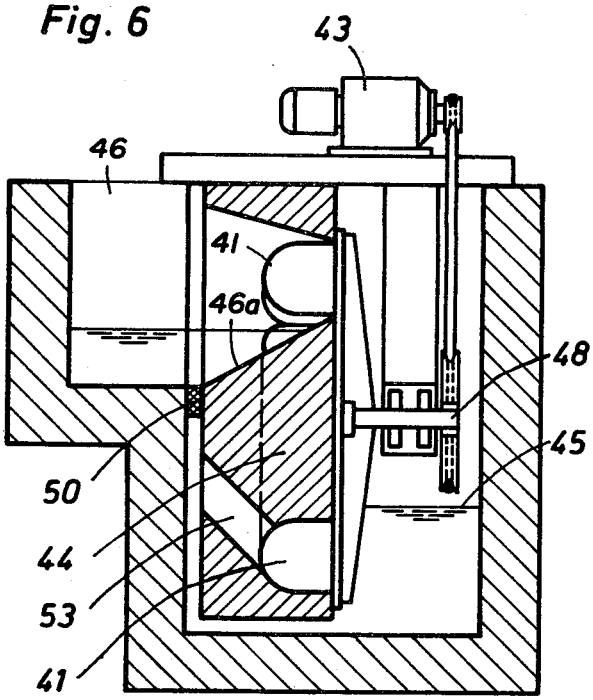
Fig. 8
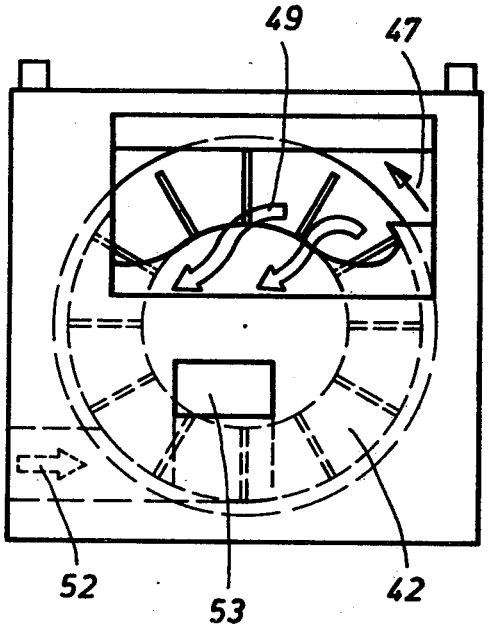
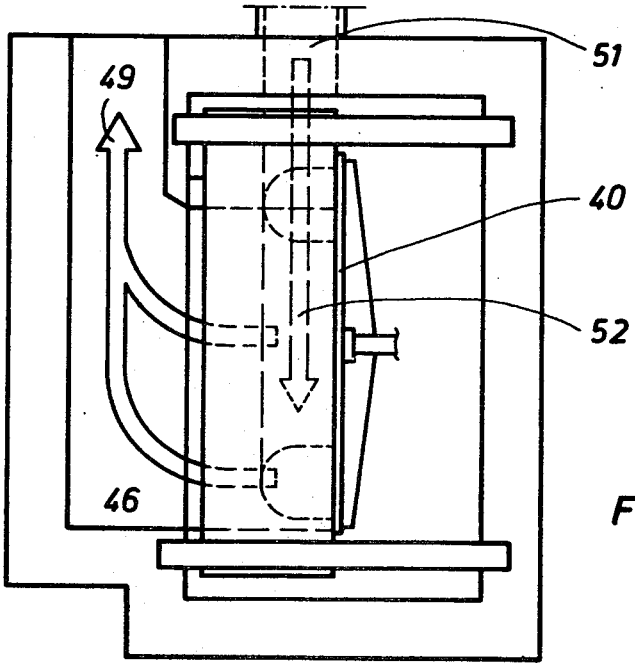
Fig. 7

LIFTING DEVICE FOR WATER, WASTE WATER, SLUDGE AND THE LIKE

This is a division of application Ser. No. 493,778, filed Aug. 1, 1974, now U.S. Pat. No. 3,994,616.

The invention relates to a conveying device for the conveyance of water or of aqueous liquids and in particular to a device for the conveyance of waste water, by means of a conveying wheel which includes conveying cells arranged in circular form.

In connection with the present invention, the concept "aqueous liquid" is intended to encompass surface water, water with organic and inorganic components, and corresponding fluid muds. The term "aqueous liquid" includes also other goods to be conveyed which, in their behaviour, resemble the described liquids to such an extent that they can be conveyed with similar conveying devices. It is known in the prior art to provide conveying devices with scooping bowls and scooping cups which take up aqueous liquids in the pickup region, by filling up the scooping bowls or scooping cups, and which convey said aqueous liquid to a higher located discharge region. Such conveying wheels have also been constructed with an inwardly directed discharge of the goods to be conveyed, whereby a low hoisting height and a relatively long time period of the discharge process show up as disadvantages. As a result of this, a bigger discharge area is required, which unfavorably influences the hoisting height and the cross-section of the discharge chute. Furthermore, if optimum flow-line conditions are to be realized during the uptake and discharge of the goods to be conveyed, a complicated design of the scooping bowls moreover follows. Furthermore, owing to the required minimum discharge, the circumferential speed of such scooping wheels is limited.

A further known means for the conveyance of liquids and muds consists in the arrangement of worm conveyors which, if necessary, are joined one behind the other in cascade form. The large cross-sectional area of the worm conveyor is operative only within a relatively small area as conveying space.

The present invention is based on the task of creating a conveying device for the conveyance of water or aqueous liquids, in particular for the conveyance of waste water. Thereby, an overall design of simple construction is strived for, which eliminates complicatedly shaped structural components and which can be installed without disturbance and without maintenance under conditions of contaminations. The characteristic feature of the invention is to be seen therein that in the uptake region, the conveying wheel, which is provided with one-sidedly open cells lying in a plane perpendicular to the axis of rotation, dips into the level of liquid, that at least the region of the upward conveyance is covered over by a stationary wall portion, which closes off the one-sidedly open cells of the conveying wheel along the conveying route, and that in the discharge region of the conveying wheel a receiving vessel is located, the leading edge of which extends in axial direction at least up to the edge of the conveying wheel. Such a type of conveying device with one-sidedly open cells lying in a plane perpendicular to the axis of rotation, makes possible the transport of large quantities and furnishes the maximum hoisting height possible for a given diameter. The cells which can be constructed with large spatial dimensions can not become clogged and can not wind themselves around one another. The structure of the present invention creates a uniform discharge flow, whereby for a given diameter of the conveying wheel a considerably greater discharge-, and uptake-area is at one's disposal in comparison with a scooping wheel with discharge on the inner side. The overall arrangement is favorable from the viewpoint of flow-line techniques and displays low splashing losses in the pump sump. As regards the conveying wheel, the conveying device can be produced by simple constructive means in a dimensionally stable manner and the leakage water, appearing from the one-sidedly open cells opposite the stationary wall portion, can serve as a liquid seal, the use of which is sufficient in many cases.

In a further embodiment of the invention it is possible that, by means of a trough-shaped member, the receiving vessel engages with the free internal area of the conveying wheel. Through this, the uptake of the liquid in the receiving vessel is improved.

If necessary, a wall portion of the collecting vessel can be expediently adapted in an arched manner to the inner surface area of the conveying wheel. Spray water losses can be avoided by means of this construction. The receiving vessel can advantageously lie parallel to the conveying wheel.

A preferred form of the present invention can be produced in such a manner so that the conveying wheel is provided with a unilaterally disposed circular disc, which bears two concentric hollow cylinders, between which radially extending separation walls are arranged, and that at the open side of the conveying wheel, the leading edges of the separation walls and of the hollow cylinders lie in a plane which is perpedicular to the axis of rotation of said conveying wheel. Such a set-up can be produced in a particularly simple manner from commercially available bases or plates which have been machined along their circumference and as far as its dimensions are concerned, can be adapted to the most diverse conveyance conditions. In a particularly easy manner, a greater discharge quantity can be achieved through a broadening of the conveying wheel.

For the improvement of the discharge process it can be expedient that the one-sidedly open cells have at least one wall surface which extends in a slanted direction. A preferred embodiment can consist of a slanted wall surface that is created thereby such that the inner hollow cylinder is shaped conically with respect to the axis of rotation, whereby the inclination of the cell wall surface extends in out-flow direction toward the axis of rotation. In another embodiment which is expedient in given cases, the separation walls of the cells are arranged in direction of rotation with respect to the axis of the conveying wheel.

An expedient further development of the invention, if necessary, can be achieved whereby two one-sidedly open conveying wheels are combined as structural unit. In this manner, through the combination of two stationary wall portions, a doubling of the conveying capacity and a more uniform loading of the conveying wheel results.

It can be furthermore expedient, that additional sealing elements of different types are arranged between the stationary wall and the conveying wheel within the region of the conveyance route. If necessary, an appropriate embodiment can be attained whereby, between the outer circumference of the two hollow cylinders of the conveying wheel and the stationary wall portion, interlocking members, of the type of a labyrinth seal, are arranged. However, the sealing elements advantageously can also contain rubber-elastic sealing beads or other known seals. In an advantageous manner, the labyrinth seal can also be constructed in form of a peripheral groove in the frontal surface area of the cylindrical walls of the conveying wheel and/or in the corresponding counter abutting surface of the stationary wall portion.

Since the conveyed quantity depends on the clearance losses between the one-sidedly open conveying wheel and the stationary wall portion, it appears to be expedient to see to it that the gap width is adjustable, for example, through shifting of the stationary wall portion or shifting of the conveying wheel with its mounting. Moreover, the conveying capacity is also determined by the speed of rotation of the conveying wheel, whereby in comparison to the known scooping wheels, higher rates of revolutions can be attained. Accordingly, the leakage losses are reduced through the leaking water which, in the gap clearance, flows in reverse flow in an undesired manner from the cells.

In an alternative embodiment the one-sidedly open cells of the conveying device are likewise closed off by the stationary wall member in the region of the upward conveyance but the actual conveying cells are formed in a duct-like annular groove of the stationary wall member by means of the separation walls which are connected with the revolving circular disc, whereby the cross-section of the annular groove approximately corresponds to the profile of the separation walls rotating therein.

in an advantageous manner, the stationary wall member can be used as finished structural component in concrete or the like, should it be suspended as a unit with the conveyance device in the pump sump, whereby it is sealed off from the duct wall by means of a seal.

If the annular groove is to be closed-off by revolving means which, to give an example, is particularly expedient in the case of an arrangement of several conveying devices in an upward cascade, said annular groove can be provided with a vent-, and/or intake-opening in the uptake region.

In this type of arrangement an improvement of the discharge process can be achieved expediently through an outwardly sloping inclination of the bottom of the receiving vessel or of the stationary wall member's inflow section to the receiving vessel.

For greater hoisting heights, several conveying wheels can be advantageously joined one beind the other in cascade form at different vertical positions.

The characteristic features of the invention furnish a conveying device in which large quantities of transported aqueous liquids can be efficiently conveyed as well as considerable proportions solid matter.

Figure 3:
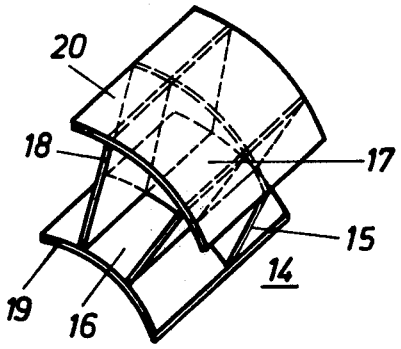
Figure 5:
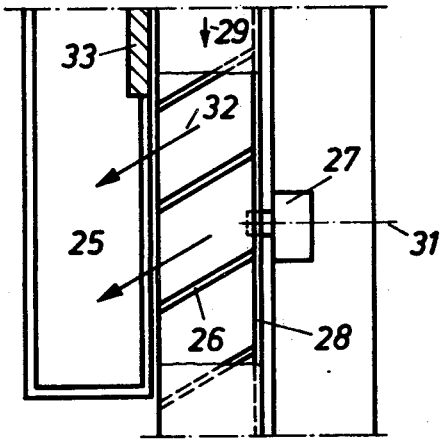
Figure 2:
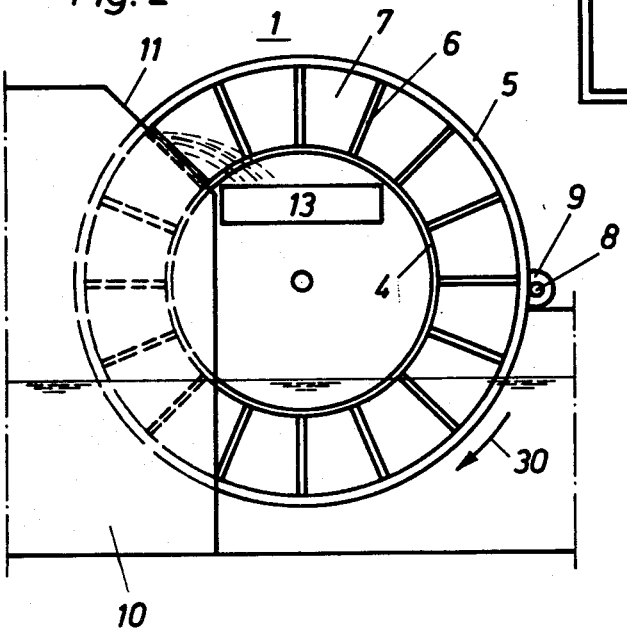
Figure 4:
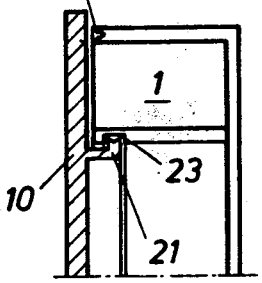

In the drawing, two exemplified embodiments of the the present invention are represented schematically, from which further characteristics of the invention result:

FIG. 1 is an elevational cross-section view taken along the axis of rotation of the conveying wheel, through a conveying device designed according to the present invention, FIG. 2 is a partially sectioned side elevational cutout view of the conveying device according to FIG. 1, FIG. 3 is a perspective view of a double, conveying wheel, FIG. 4 is a fragmentary elevational view, partially in section, illustrating a conveying wheel with peripheral sealing, FIG. 5 is a partially sectioned top plan-view of the discharge location of an alternate embodiment of the conveying wheel, FIG. 6 is an elevational view in cross-section taken along the axis of rotation of the conveying wheel through another alternate embodiment of the conveying device designed according to the invention, FIG. 7 is a top-view of the arrangement shown in FIG. 6, FIG. 8 is a side elevational lateral view of the wall and of the partially covered conveying wheel of the arrangement shown in FIG. 6.

In the case of the conveying device illustrated in FIGS. 1 and 2, a conveying wheel 1 is provided with a circular disc 3 that is journaled for rotation unilaterally or in a cantilevered manner in a mounting 2, with said circular disc 3 being connected with an internal hollow cylinder or ring 4 and an external hollow cylinder or ring 5. Between the two concentric hollow cylinders or rings 5 separation walls 6 lie in radial direction, which subdivide the annular space created by the hollow cylinders 4,5 into individual cells, for example into cells 7.

Via a friction wheel 8, the one-sidedly open conveying wheel 1 is driven by an electric motor 9. Opposite the open side of the conveying wheel 1, a stationary wall member 10 is arranged which, along the conveying region, closes off the one-sidedly open cells 7 of the conveying wheel 1. At the start of the discharge region, a sloping section 11 is provided at the stationary wall member 10, with said sloping section 11 extending radially in direction toward the axis of rotation of the conveying wheel 1. Through this sloping section 11, the individual cells are in each case set free propitiously for the discharge process.

Between the stationary wall member 10 and the conveying wheel 1, a slit or gap is present, the size of which can be determined by an adjusting device not shown in the drawing.

A liquid level 12, into which the conveying wheel 1 plunges with its uptake-region and with a portion of the conveying region, is conveyed with the aid of the conveying wheel 1 into a trough-shaped receiving vessel 13, which projects into the free internal area of the conveying wheel 1.

During the operation of the conveying device, the conveying wheel 1 is driven in the direction of arrow 30. Cells 7 fill up thereby in the uptake region and are closed off in the conveying region through the wall portion 10. In addition, a liquid sealing takes place with the aid of the leaking water which emerges from between the open front side of the conveying wheel 1 and the stationary wall portion 10. After the radial separation wall 6 of a corresponding cell 7 has passed the sloping section 11 of the stationary wall portion 10, the discharge process begins, in the course of which the transported goods are discharged into the receiving vessel 13.

In FIG. 3, the arrangement of a double acting conveying wheel 14 is shown in form of a sectional portion, whereby said conveying wheel 14, through separation walls 18 as well as through an internal and an external hollow cylinder 19, 20 on both sides of a circular disc 15, forms cells 16, 17.

FIG. 4 discloses the arrangement of labyrinth seals between the conveying wheel 1 and the stationary wall portion 10. At the external and internal hollow cylinder (corresponding to the rings 4 and 5 in FIGS. 1 and 2), different seals are illustrated, of which each individual one can also be chosen in place of the other. In the internal hollow cylinder 4, a sealing ledge 21 fitted in manner of a circular arc, engages in a groove 23 and thus forms one labyrinth seal. Along the external hollow cylinder, the front surface lying opposite the stationary wall portion 10, is constructed in form of a sealing ledge. Through a revolving sharp-edged front groove 22 an additional labyrinth seal is also formed with respect to the flat surface area of the stationary wall portion 10.

FIG. 5 illustrates another embodiment of the conveying wheel in connection with the receiving vessel in the area of the discharge location. The conveying device of this embodiment is also provided with a conveying wheel journaled for rotation in a mounting 27, with said conveying wheel having a circular disc 28 with attached internal and external hollow cylinders (corresponding to rings 4 and 5 in FIGS. 1 and 2). The individual cells are formed through separation walls 26 which are mounted at a fixed angle with respect to the axis of rotation 31. During the conveying process, the cells are sealed off by a stationary wall portion 33. During angular movement in rotational direction 29, the cells are opened above a receiving vessel 25. Guided by the separation walls 26 which are mounted in rotational direction 29, the conveyed goods flow out in outflow direction 32. In this type of construction, the receiving vessel is arranged parallel to the conveying wheel. At a given external diameter of the conveying wheel, the hoisting height of the device can be increased hereby in comparison to a construction displaying a receiving vessel which projects into the free inner area of the conveying wheel. In an advantageous manner, the top edge of the receiving vessel 25 can be drawn upwardly thereby up to approximately the apex of the internal hollow cylinder.

In FIGS. 6, 7 and 8, an alternate form of the conveying device is illustrated. In the region of ascent, cells are likewise formed here by a revolving part and by a stationary wall member. A motor 43 rotates a shaft 48, thereby revolving a circular disk 40 which is secured to the shaft 48. Onto the revolving circular disc (FIG. 7) 40, separation walls 41 are mounted, which engage with a duct-like annular groove in the stationary wall member 44. The profile of the annular groove corresponds to the profile of the revolving separation walls 41, so that only a slight gap is formed between the revolving separation walls 41 and the stationary wall member 44. In the uptake region, the conveying wheel consisting in essence of the circular disc 40 and of revolving separation walls 41, dips into the liquid level 45 and the duct formed by the annular groove is filled up by the revolving separation walls 41 in the manner of a piston flow. The water which is supplied or sucked-in in the feeding direction 52, is hoisted upwardly by the wheel and, in the upper area, is discharged into the receiving vessel 46 in an outflow direction. In an advantageous manner, the receiving vessel 46 and the inlet section within the stationary wall member 44 leading to the receiving vessel 46 is provided with a sloping bottom 46*a*. Through this, an especially rapid emptying of the cells is achieved. According to the invention, the stationary wall member can be advantageously constructed as finished structural component in concrete or the like, as is illustrated in FIGS. 6, 7 and 8. Under such circumstances, the finished part is advantageously sealed off from the duct wall by means of a seal 50. The stationary finished constructural component 44 can be mounted on the same constructural unit as the driving unit with the electric motor 43 and the conveying wheel. An especially good alignment and installation result hereby in the manufacturer's plant or outside of the duct region at the construction site, so that the geometrical prerequisites for a faultless operation and functioning of the conveying device is given.

In FIG. 8, the back side of the stationary wall 44 is illustrated as a finished constructural component. An inflow opening 52, a vent opening 53, as well as the discharge opening in the upper region, open into the duct-like annular groove. On rotation of the conveying wheel in rotational direction 47, the separation walls 41 form the described closed-off cells 42. The water is conveyed in feeding direction 52 and is given off in outflow direction 49 in the upper region. During the filling of cells 42 with water, the air which is still contained in the cells can escape through the vent opening 53 into the region above the liquid level 45. Through the upper slope of the upper discharge opening, new air can likewise flow back again into the cells. The emptying of the cells in the sense of outflow direction 49 is guaranteed to an especially high degree.

In the embodiment of the arrangement of a stationary wall as a finished constructural component designed according to FIG. 8, it is expedient to construct the inflow opening 51 in FIG. 7 directly in the feeding direction 52 with the inflow opening in the stationary wall member 44. The stationary wall member, both as a finished constructional component as well as a duct wall, can be open in the downward direction in the lower uptake region. In this case, the vent opening 53 can be eliminated.

We claim:

1. A conveying device for conveying liquid from a supply well, comprising in combination:
   - an upright wall having two sides and including an annular groove defined in one side dipping into said well;
   - conveying means at least partially disposed in said well, and comprising a disk rotatably mounted about a substantially horizontal axis and a plurality of separations connected to said disk about said axis along a mean diameter corresponding to that of said groove, said separations substantially corresponding in outline to and moving in said groove, said disk and said separations and the surfaces of said groove defining cells for conveying said liquid through at least a part of said groove; and
   - an output channel defined in said wall and intercommunicating with a top portion of said groove for emptying liquid from said cells;
   - whereby, when said disk is rotated, it will move said separations into said liquid and said cells substantially will retain their liquid content until they reach said output channel.

2. The device as claimed in claim 1, wherein said output channel comprises a discharge opening and further comprising a receiving vessel disposed near said discharge opening for receiving the liquid discharge.

3. The device as claimed in claim 2, wherein said upright wall has a bottom inclination declining away from said discharge opening.

4. The device as claimed in claim 1, wherein said wall defines a vent opening interconnecting with a bottom portion of said groove for venting gas from said cells when each is being filled with said liquid.

* * * * *